United States Patent [19]

Vlahek

[11] 4,428,262

[45] Jan. 31, 1984

[54] ADJUSTABLE LONG LIFE STRIPPER

[76] Inventor: Charles D. Vlahek, 4807 W. Main St., Belleville, Ill. 62223

[21] Appl. No.: 396,803

[22] Filed: Jul. 9, 1982

[51] Int. Cl.[3] ..... B26D 7/06

[52] U.S. Cl. ..... 83/139; 30/358

[58] Field of Search ..... 30/368, 358, 367, 366; 145/46; 83/139, 700

[56] References Cited

U.S. PATENT DOCUMENTS

| | | | |
|---|---|---|---|
| 42,228 | 4/1864 | Sanders | 30/368 |
| 376,009 | 1/1888 | Raynal | 145/46 |
| 1,378,698 | 5/1921 | Lindstrom | 145/46 |
| 2,083,476 | 6/1937 | Rossin | 30/358 |
| 2,250,434 | 7/1941 | Dugaw | 145/46 |
| 2,570,055 | 10/1951 | Gasdia | 30/366 |
| 2,757,457 | 8/1956 | Ziegelski | 30/366 |
| 3,862,516 | 1/1975 | Broscoff et al. | 145/46 |

FOREIGN PATENT DOCUMENTS

| | | | |
|---|---|---|---|
| 1202767 | 7/1959 | France | 145/46 |
| 1325745 | 3/1963 | France | 30/366 |
| 2549 | of 1872 | United Kingdom | 145/46 |
| 614526 | 12/1948 | United Kingdom | 30/367 |

*Primary Examiner*—Frederick R. Schmidt
*Assistant Examiner*—J. T. Zatarga

[57] ABSTRACT

This adjustable stripper tool is for use in custom tooling, magnetic tooling, and adjustable tooling, where a punching machine is employed. Primarily, it consists of a hollow cylindrical main body, which is received on a punch of the machine, and it is adjustable in length by placing or removing a multiple number of spacers in its metal cap, which is force-fitted on the open end of the main body.

1 Claim, 6 Drawing Figures

ADJUSTABLE LONG LIFE STRIPPER

This invention relates to tools, and more particularly, to an adjustable long life stripper.

The principal object of this invention is to provide an adjustable long life stripper, which will be employed in custom, magnetic, and adjustable tooling, so as to prevent having to use a protective coating, as was used in the prior art, to prevent marking and damaging the material in punching operations.

Another object of this invention is to provide an adjustable long life stripper, which will be adaptable for punching both light and heavy material.

Another object of this invention is to provide an adjustable long life stripper, which will be non-marking, non-cupping, non-extruding, and will also provide for longer punch life.

A further object of this invention is to provide an adjustable long life stripper, which will operate with the same pressure on full length punches and short punches.

A still further object of this invention is to provide an adjustable long life stripper, which will shape holes at no extra cost, and will also have inexpensive tube replacements.

An even further object of this invention is to provide an adjustable long life stripper, which will employ a reusable twist-on friction cap, and also resusable spacers, for saving in set-up time.

Other objects of the present invention are to provide a long life stripper, which is simple in design, inexpensive to manufacture, rugged in construction, easy to use and efficient in operation.

These, and other objects, will be readily evident upon a study of the following specification and the accompanying drawing wherein.

Figure 1:
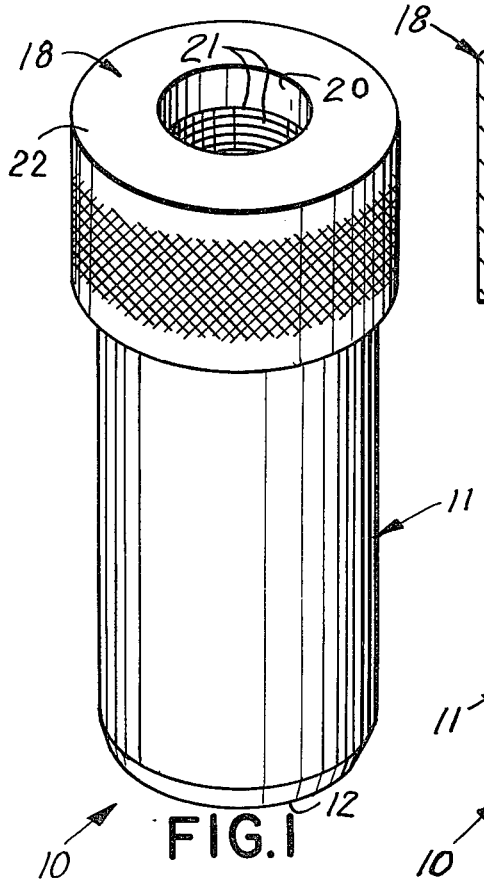
FIG. 1 is an enlarged perspective view of the present invention, shown removed from FIG. 3.
Figure 2:
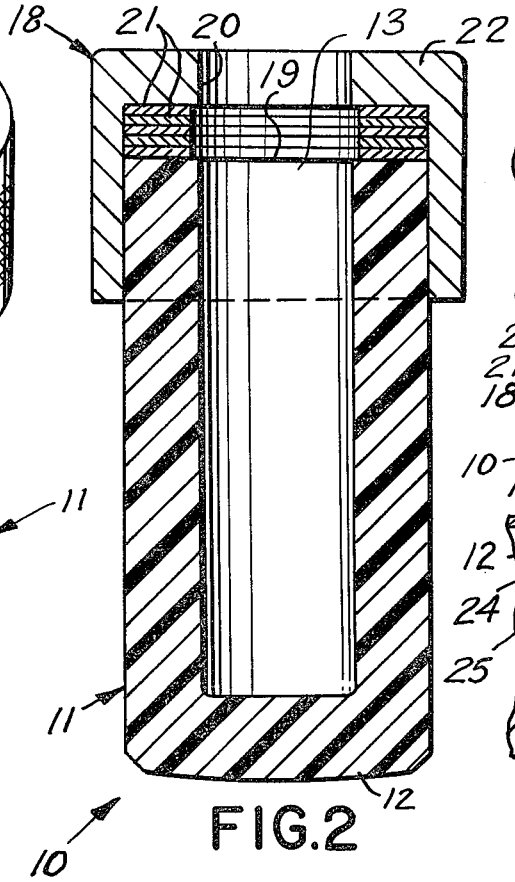
FIG. 2 is a vertical cross-sectional view of FIG. 1, shown in elevation.
Figure 3:
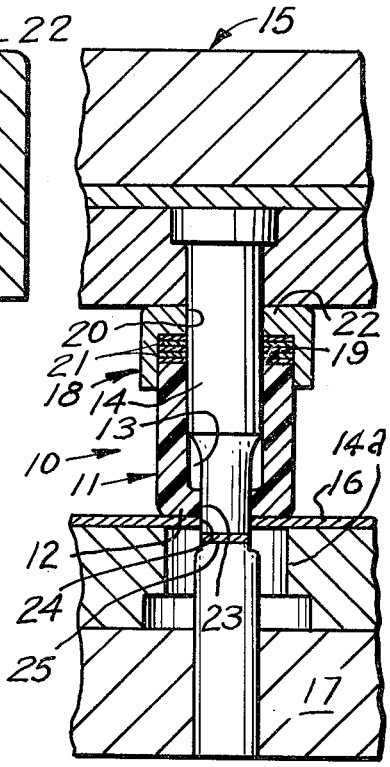
FIG. 3 is a fragmentary cross-sectional side view of a top and bottom die shoe and material, showing the invention in use and in section.

According to this invention, a stripper 10 is shown to include a urethane plastic main body 11, having an end wall 12 integral therewith. The outer surface of end wall 12 is slightly convex and beveled at its outer periphery, and the bore 13 of main body 11 removably receives punch 14 of the top die shoe structure 15. The end wall 12, of main body 11, serves to engage with the material 16 on the bottom die show 17 structure, and a metal cap 18 is frictionally and removably received on the open end 19 of main body 11. A central opening 20, through cap 18, serves as a means of removably receiving punch 14, and a plurality of circular spacers 21 engage with each other, and one of the outer spacers 21 of the plurality engages with the open end 19 of main body 11, and the other outer spacer 21 of the plurality engages with the end wall 22 of cap 18. The spacers 21 are removed as desired, so as to adjust the overall length of the stripper 10 assembly, which is necessary for different die operations, and the outer periphery of cap 18 is knurled, so as to be easily gripped by the user when forcing cap 18 onto the main body 11.

In use, one or more of the spacers 21 are removed from cap 18, to adjust the stripper 10 to the proper length for the punch 14 and die **14*a* used, and the metal cap 18 is then gripped by the user and force-fitted onto the open end 19 of main body 11. The stripper 10 assembly is then urged onto the punch 14, and, during a punching operation, the punch 14 will push an opening 23 through end wall 12 and simultaneously, disc 25 will be punched free of material 16, and will leave the opening 24 therein, which will not be marked, cupped, etc. The main body 11** will be used continually thereafter, and when worn, is easily replaced by a similar one.

Figure 6:
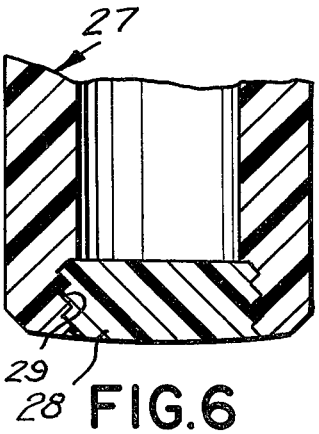
FIG. 6 is a fragmentary elevational view, showing another modified form of the invention.

Referring now to FIG. 6, a modified main body 27 is shown to include an insert or slug 28, of hard urethane material, which is externally threaded and is threadingly received and cemented in internally threaded opening 29, at the bottom of main body 11.

In use, main body 27 functions in the same manner as was heretofore described of main body 11, with the exception, that opening 29 is preformed, and insert 28 is punched out, by means of punch 14.

Figure 4:
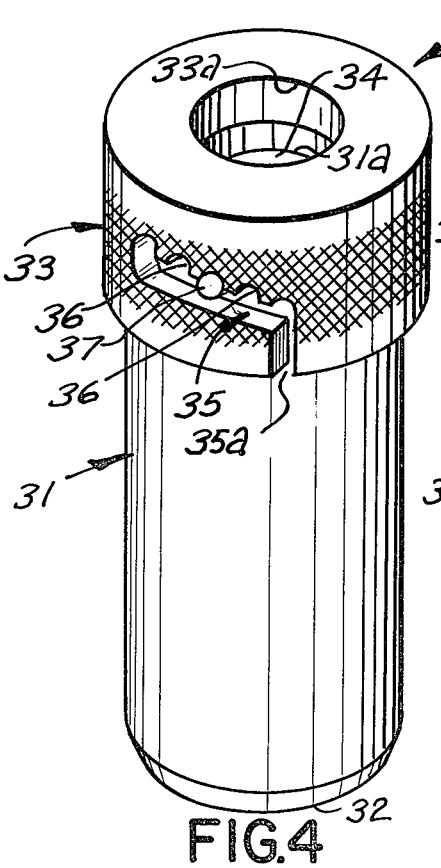
FIG. 4 is an enlarged perspective view of a modified form of the invention.
Figure 5:
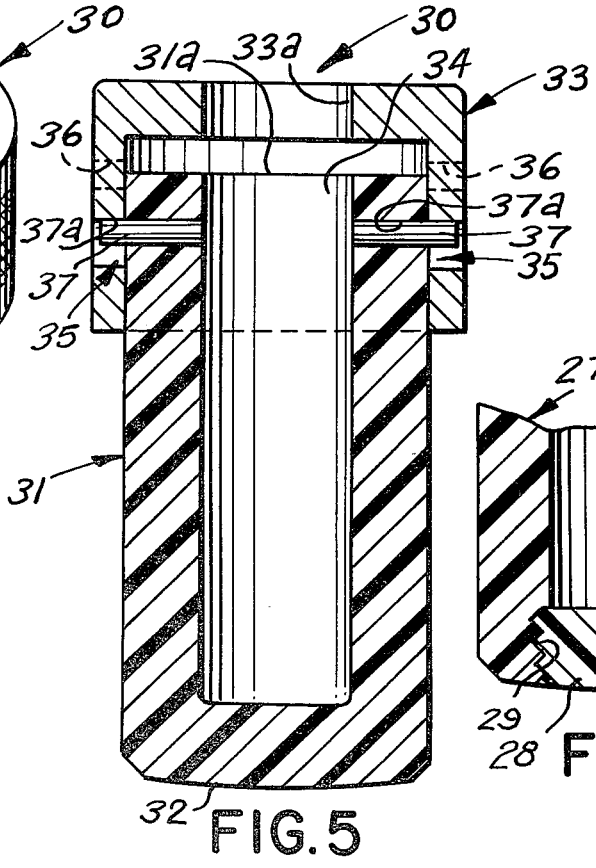
FIG. 5 is a vertical cross-sectional view of FIG. 4, shown in elevation.

Looking now at FIGS. 4 and 5 of the drawing, a modified form of stripper 30 is shown to include a plastic main body 31, having an end wall 32, similar to end wall 12 of main body 11 of stripper 10, heretofore described. A metal cap 33 is knurled on its outer periphery, and is fitted onto the open end **31*a* of main body 31 of the user's fingers. The bore 34 of main body 31 aligns with opening 33*a* through cap 33, for receiving the punch 14, and a pair of oppositely opposed bayonet-type cut-out slots 35, through cap 33, are angularly sloped upwards, and include a plurality of equally spaced-apart indentations or recesses 36, which may alternately receive the oppositely opposed and projecting pins 37, which are force-fitted in the openings 37*a*, through the upper extremity of main body 11, and the combination of the pins 37 and the slots 35 serve as adjustment means, to lengthen or shorten the stripper 30** assembly when necessary.

In use, stripper 30 functions in the same manner as was heretofore described of stripper 10, with the exception, that the cap 33 is rotated and urged downward or upwards, with the pins 37 being positioned in whichever indentation 36 desired, to obtain the proper overall lengthening of the stripper 30.

It shall be noted, that when cap 33 is being placed onto main body 31, the pins 37 must first be entered into the vertical portions **35*a* of slots 35, before any shortening or lengthening of stripper 30** can be effected.

While various changes may be made in the detail construction, it is understood that such changes will be within the spirit and scope of the present invention, as is defined by the appended claims.

What is claimed as new is:

1. An adjustable long life stripper, comprising, in combination, a hollow, cylindrical main body having an end wall on one end thereof and an opening on an opposite and thereof, and a cup-shaped adjustably mounted on said opposite end, a central opening through said cap for receiving a punch therethrough, a pair of bayonet slots on opposite sides of said cap, a pair of outwardly protruding pins on opposite sides of said main body for engagement in said bayonet slots, and each said bayonet slot comprising an axially extending portion and a circumferentially extending portion which is angularly inclined, said angularly inclined portion including a row of notches along its length for seating said pins selectively.

* * * * *